US008578659B2

(12) United States Patent
Parigoris et al.

(10) Patent No.: US 8,578,659 B2
(45) Date of Patent: Nov. 12, 2013

(54) ACCESSIBLE CONTROL PANEL FOR OVERHEAD ELECTRICAL APPARATUS IN A SUSPENDED CEILING SYSTEM

(75) Inventors: Ronald J. Parigoris, Kings Park, NY (US); Wayne A. Gutschow, Yaphank, NY (US); Benjamin Hartman, New York, NY (US)

(73) Assignee: Nexter Power Systems, Inc., Detroit, MI (US)

( * ) Notice: Subject to any disclaimer, the term of this patent is extended or adjusted under 35 U.S.C. 154(b) by 768 days.

(21) Appl. No.: 12/322,133

(22) Filed: Jan. 29, 2009

(65) Prior Publication Data

US 2010/0187370 A1 Jul. 29, 2010

(51) Int. Cl.
*E04C 2/52* (2006.01)
*H02B 1/30* (2006.01)

(52) U.S. Cl.
USPC ..... 52/39; 52/220.6; 52/506.06; 52/741.1; 174/61; 174/63; 312/245

(58) Field of Classification Search
USPC ..... 52/39, 506.06, 220.1, 220.6, 741.1; 174/61, 63; 248/343; 362/147, 404, 362/366; 312/242, 245, 223.1, 223.6
See application file for complete search history.

(56) References Cited

U.S. PATENT DOCUMENTS

| | | | | |
|---|---|---|---|---|
| 2,926,237 | A * | 2/1960 | Sorenson | 362/150 |
| 3,848,385 | A | 11/1974 | Thompson | |
| 4,829,725 | A | 5/1989 | Gustaveson et al. | |
| 4,843,782 | A * | 7/1989 | Gustaveson et al. | 52/39 |
| 5,057,980 | A | 10/1991 | Russell | |
| 5,148,282 | A * | 9/1992 | Sedighzadeh | 348/825 |
| 5,911,661 | A * | 6/1999 | Murray et al. | 52/220.6 |
| 6,121,737 | A * | 9/2000 | Guenther et al. | 318/266 |
| 6,341,466 | B1 * | 1/2002 | Kehoe et al. | 52/712 |
| 6,990,393 | B2 | 1/2006 | Parker | |
| 7,568,313 | B1 * | 8/2009 | Matley | 52/39 |
| 7,795,533 | B2 * | 9/2010 | Bravo et al. | 174/50 |
| 8,083,300 | B2 * | 12/2011 | MaCall | 312/245 |
| 2009/0230827 | A1 * | 9/2009 | MaCall | 312/223.1 |
| 2010/0000758 | A1 * | 1/2010 | Bravo et al. | 174/60 |

* cited by examiner

*Primary Examiner* — Robert Canfield
*Assistant Examiner* — Jessie Fonseca
(74) *Attorney, Agent, or Firm* — Kirschstein, et al.

(57) ABSTRACT

An overhead arrangement, for use in a suspended ceiling system having a grid framework of frame elements lying in a ceiling plane and bounding a plurality of openings for supporting a corresponding plurality of ceiling members, includes an electrical apparatus, such as a DC power supply, a support for supporting the electrical apparatus on the framework at an elevation above one of the ceiling members supported in one of the openings, and a slanted control panel on the housing and having manually accessible controls and visually accessible displays. The slanted control panel is obliquely and downwardly inclined relative to the ceiling plane to enable manual access to the controls and visual access to the displays through the opening to the slanted control panel from below the framework after the ceiling member is at least partially removed from its opening without mechanical interference between the ceiling tile and the electrical apparatus.

17 Claims, 6 Drawing Sheets

ACCESSIBLE CONTROL PANEL FOR OVERHEAD ELECTRICAL APPARATUS IN A SUSPENDED CEILING SYSTEM

DESCRIPTION OF THE RELATED ART

A conventional suspended or drop ceiling system in a building structure includes a grid framework of mutually orthogonal frame elements lying in a ceiling plane and forming a plurality of polygonal openings, typically quadrilateral, into which ceiling tiles, light fixtures, air ducts, loudspeakers and like ceiling members are inserted and supported. The ceiling system provides, among other things, a visual, and often acoustic, barrier to building infrastructure, such as sprinkler pipes, water pipes, air conditioning duct work, electrical conduits, electrical power cables, telephone cables, computer network cables, cable trays, electrical junction boxes, as well as other mechanical and electrical services, routinely mounted in an overhead plenum or space between a real ceiling of the building structure and the suspended framework.

As a result, the overhead plenum is crowded with mechanical and electrical infrastructure services, which is often difficult to service and reconfigure, particularly due to the presence of a complex, maze-like network of cables in the plenum. The infrastructure services typically include an electrical apparatus for monitoring and controlling various of the infrastructure services to which the electrical apparatus is operatively connected. It is especially desirable to supply direct current (DC) voltage to power electrical equipment in an office environment and, hence, the electrical apparatus can be a DC power supply, or any component used to control the DC power, or even an electrical junction box to route the DC power. Access to such electrical apparatus is desirable, especially for routine maintenance and repair.

However, such access is not readily available due to the crowded environment of the plenum. To reach such electrical apparatus, it is typically necessary to remove, or at least move, at least one of the ceiling members, e.g., a ceiling tile, from its corresponding opening in the grid framework. However, removal of the ceiling tile is often thwarted, because the electrical apparatus blocks such movement. For example, the electrical apparatus may be resting directly on top of the ceiling tile, or the electrical apparatus may be positioned so closely to the ceiling tile that only limited movement of the ceiling tile is permitted before the electrical apparatus blocks any continued movement. Sometimes, it is necessary to move other equipment and/or cables in the plenum that are blocking the electrical apparatus, and sometimes the electrical apparatus itself must be moved or even removed from the plenum to gain sufficient access. This is labor-intensive and time-consuming and represents an undesirable expense. Accordingly, there is a need to provide ready access to such electrical apparatus.

SUMMARY OF THE INVENTION

One feature of the present invention resides, briefly stated, in an overhead arrangement in a suspended or drop ceiling system having a grid framework of frame elements lying in a ceiling plane and bounding a plurality of openings for supporting a corresponding plurality of ceiling members, e.g., ceiling tiles. The overhead arrangement includes an electrical apparatus having a housing for containing electrical circuitry and wiring, e.g., a DC power supply, a support for supporting the electrical apparatus on the framework at an elevation above a ceiling tile supported in an opening, and a slanted control panel on the housing. The elevation is of a height, e.g., a few inches, sufficient to enable the ceiling tile to be moved, or removed, from its opening without mechanical interference between the ceiling tile and the electrical apparatus. The slanted control panel preferably has manually accessible controls, such as switches, keys or buttons to be manually actuated by a user, and visually accessible displays, such as a screen or indicator lights to be viewed by the user.

In accordance with an aspect of this invention, the slanted control panel is obliquely and downwardly inclined relative to the ceiling plane to enable manual access to the controls and visual access to the displays through the opening to the slanted control panel from below the framework when the ceiling tile is at least partially removed from the opening. The slanted control panel may also include an openable door that is opened to gain access to the electrical circuitry and wiring contained in the housing. Preferably, the ceiling tile is easily and completely removed from its opening in the framework without mechanical interference between the ceiling tile and the electrical apparatus, thereby insuring rapid and full access to the slanted control panel, which is tilted and positioned to downwardly face the user.

In a preferred embodiment, the housing partially overlies the opening. The opening has a generally rectangular shape, and the housing has a generally triangular shape. The generally triangular housing has two side walls lying in mutually orthogonal planes that are generally perpendicular to the ceiling plane, and the slanted control panel is a third wall of the generally triangular housing. The slanted control panel meets the side walls of the generally triangular housing at two generally planar corner walls obliquely inclined relative to the side walls and the slanted control panel. The two side walls advantageously do not meet at a right angle. The support may comprise an external support structure on which the housing rests. This support structure includes support bars supportably underlying the housing, support legs extending downwardly from the support bars for a distance corresponding to said elevation, and fasteners or clips at the end regions of the support legs for detachably fastening the electrical apparatus above and to the framework at said elevation. Alternatively, the support may eliminate the support bars and comprise support legs detachably fastened to the housing, for example, at the side walls thereof, and fasteners or clips at the end regions of the support legs for detachably fastening the electrical apparatus above and to the framework at said elevation.

Thus, ready and rapid access, especially for routine maintenance and repair, is provided to the electrical apparatus. Removal of the ceiling tile is not thwarted, because the electrical apparatus does not block such movement. The electrical apparatus does not rest directly on top of the ceiling tile, nor is the electrical apparatus positioned so closely to the ceiling tile that only limited movement of the ceiling tile is enabled. It is unnecessary to move equipment and/or cables in the plenum out of the way of the electrical apparatus to gain access to the electrical apparatus, thereby minimizing labor cost and the time needed to effect infrastructure service.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
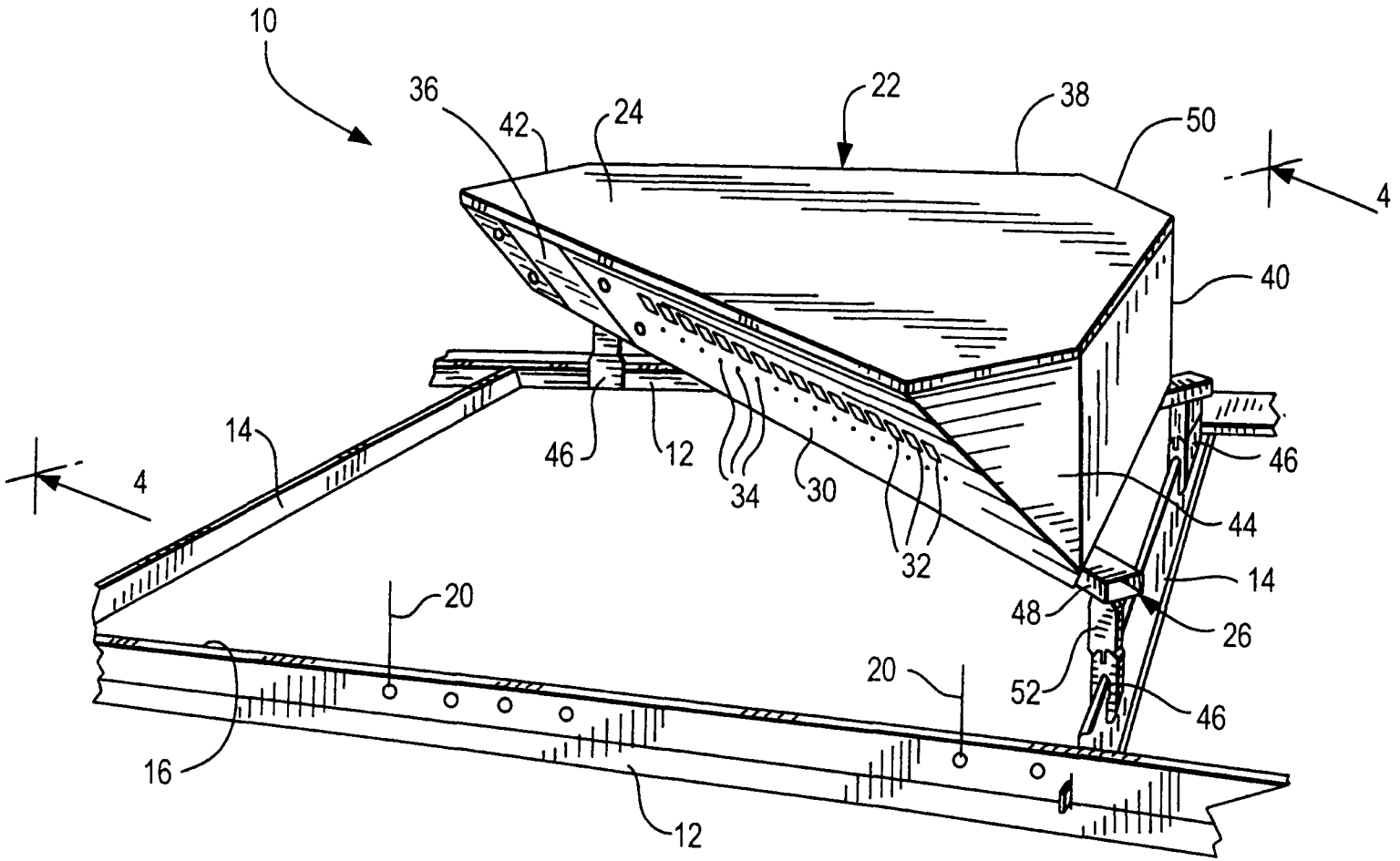
FIG. 1 is a perspective view of an overhead arrangement in accordance with this invention mounted by one embodiment of a support on a suspended ceiling system shown in a broken-away view.
Figure 4:
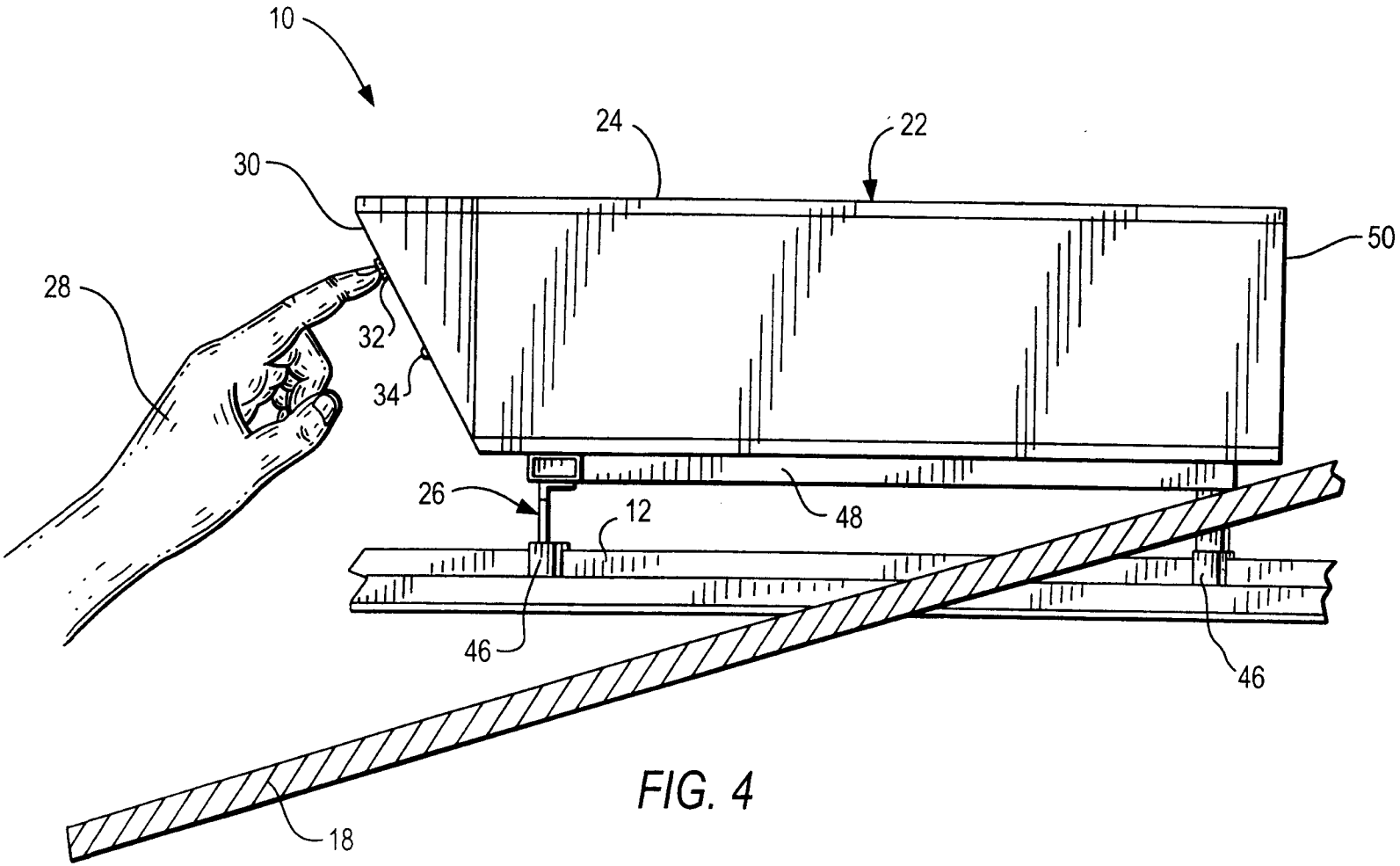
FIG. 4 is a sectional view taken on line 4-4 of FIG. 1, depicting access by a user with a ceiling tile partially removed from the suspended ceiling system in accordance with this invention.

Reference numeral 10 in FIG. 1 generally identifies an overhead arrangement in a suspended or drop ceiling system having a rectangular grid framework of mutually orthogonal frame elements 12, 14 lying in a ceiling plane and bounding a plurality of openings 16 for supporting a corresponding plurality of ceiling members, e.g., ceiling tiles 18 (see FIG. 4). Each tile 18 has a complementary contour to that of its supporting opening 16. The frame elements 12, 14 are each preferably formed, e.g., by folding and stamping, from a single piece of sheet metal. Each frame element has a generally horizontal flange portion on which the tile 18 is supported around its periphery, and a vertical web portion. The openings 16 are preferably polygonal, e.g., square or rectangular in shape, each being typically sized at 2 feet by 2 feet, or 2 feet by 4 feet, or 4 feet by 4 feet, standards. Ceiling members, such as light fixtures, air ducts, loudspeakers and the like, other than tiles 18, could also be supported in the respective openings 16. As is conventional, the ceiling system is suspended from a real ceiling of a building structure by threaded rods or ceiling wires 20.

The overhead arrangement 10 includes an electrical apparatus 22, preferably a DC power supply, having a housing 24 for containing electrical circuitry and wiring, a support 26 for supporting the electrical apparatus 22 on the framework at an elevation above the ceiling tile 18 supported in the opening 16, and a slanted control panel 30 on the housing 24. The elevation is of a height, e.g., a few inches, sufficient to enable the ceiling tile 18 to be moved, or removed, from its opening 16 without mechanical interference between the ceiling tile 18 and the electrical apparatus 22, as depicted in FIG. 4. The slanted control panel 30 preferably has one or more manually accessible controls 32, such as switches, keys or buttons to be manually actuated by a user 28 (again, see FIG. 4), and one or more visually accessible displays 34, such as a screen or indicator lights to be viewed by the user 28. The controls 32 and the displays 34 need not be arranged in parallel rows as illustrated, but can be arranged in any pattern.

Figure 2:
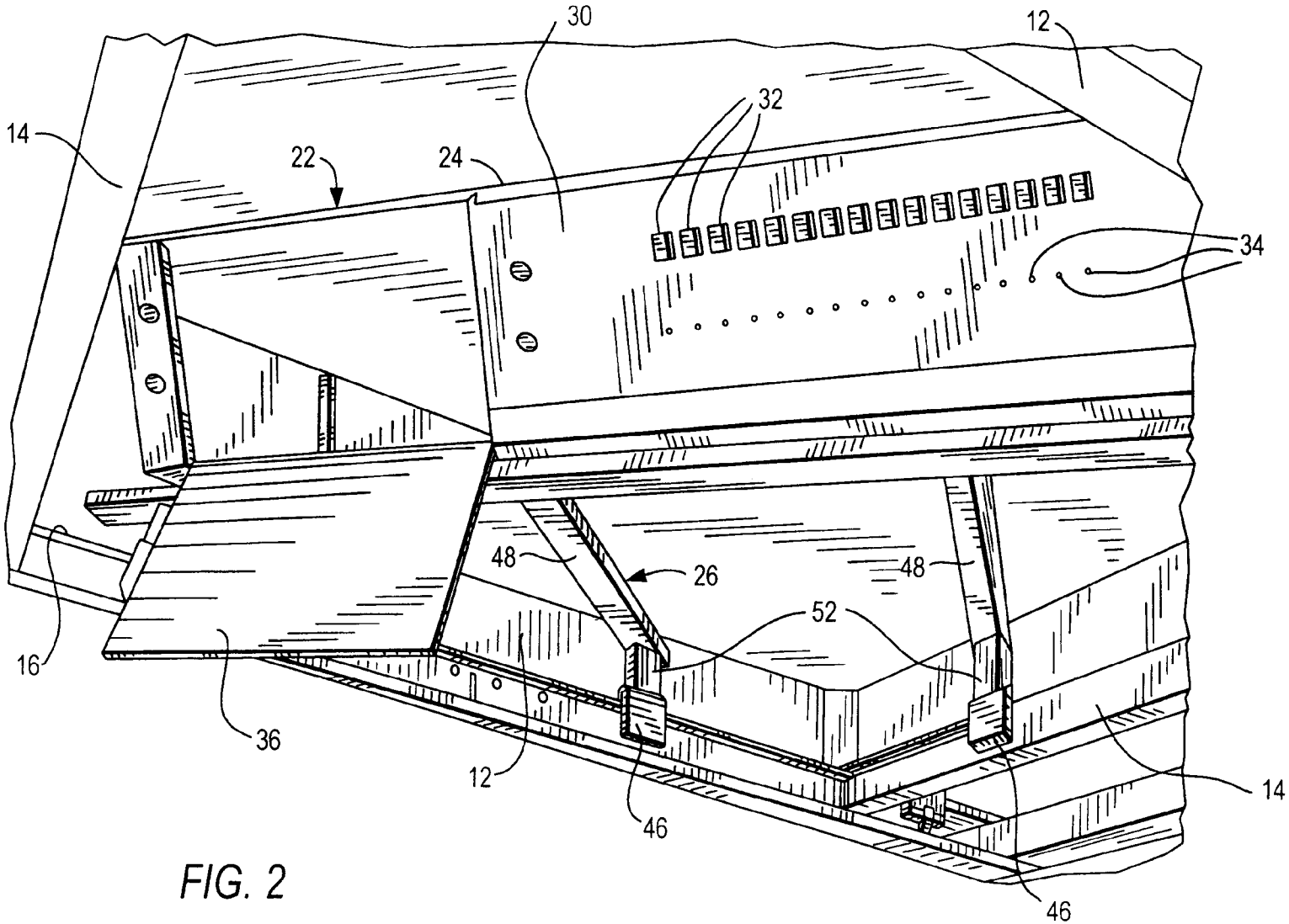
FIG. 2 is a perspective view of the overhead arrangement of FIG. 1, as seen from below, with an open door.
Figure 3:
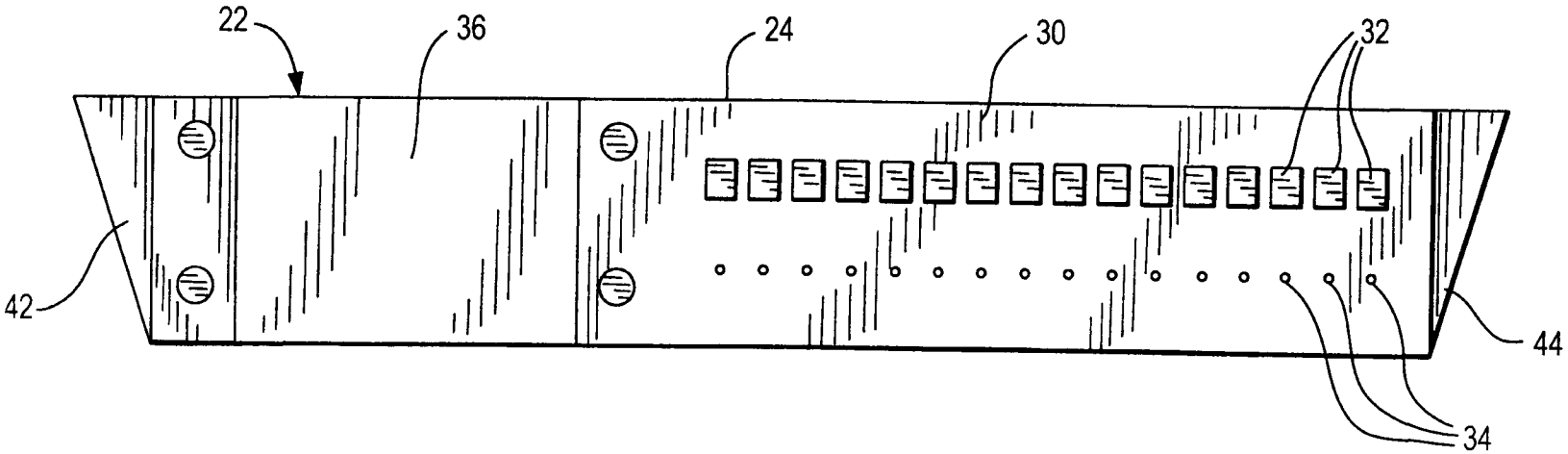
FIG. 3 is a front elevational view of an electrical apparatus of the overhead arrangement of FIG. 1, in isolation.

In accordance with an aspect of this invention, the slanted control panel 30 is obliquely and downwardly inclined relative to the ceiling plane to enable manual access to the controls 32 and visual access to the displays 34 through the opening 16 to the slanted control panel 30 from below the framework when the ceiling tile 18 is at least partially removed from the opening 16. The slanted control panel 30 may also include an openable, hinged door 36 (see FIG. 2) that is opened to gain access to the electrical circuitry contained in the housing 24. When closed, the door 36 is flush with the control panel 30. Preferably, the ceiling tile 18 is completely and rapidly removed from its opening 16 in the framework without mechanical interference between the ceiling tile 18 and the electrical apparatus 22, thereby insuring full and easy access to the slanted control panel 30, which is positioned and tilted to downwardly face the user 28. The slanted control panel 30 is preferably tilted at an acute angle of about forty-five degrees relative to the horizontal or ceiling plane. Thus, the user 28, while standing on the ground or on a ladder, can easily remove the ceiling tile 18 and physically touch the manual controls 32, or see the displays 34, or open the door 36.

In a preferred embodiment, the housing 24 partially overlies the opening 16. The illustrated opening 16 has a square shape, and the housing 24 has a generally triangular shape that overlies about one-half of the area of the opening 16. The generally triangular housing 24 has two side walls 38, 40 lying in mutually orthogonal planes that are generally perpendicular to the ceiling plane, and the slanted control panel 30 is a third wall of the generally triangular housing 24. The slanted control panel 30 meets the side walls 38, 40 of the generally triangular housing 24 at two generally planar corner walls 42, 44 obliquely inclined relative to the side walls 38, 40 and the slanted control panel 30. The corner walls 42, 44 provide clearance for the user's hands during installation or removal of the electrical apparatus 22, as well as clearance for any ceiling wires 20 that might be present at that corner location. The side walls 38, 40 preferably do not meet at a right angle, but instead another corner wall 50 is obliquely inclined relative to the side walls 38,40. The corner wall 50 also provides mechanical clearance for any ceiling wire 20 that might be present at that corner location.

The support 26 includes support bars 48 supportably underlying the housing 24 of the electrical apparatus 22, support legs 52 extending downwardly from the support bars 48 for a distance corresponding to said elevation, and fasteners or clips 46 for detachably fastening the electrical apparatus 22 above and to the framework at said elevation. The clips 46 friction tightly engage the vertical web portions of the frame elements 12, 14 with a snug fit. The electrical apparatus 22 is preferably bolted to the bars 48.

Figure 5:
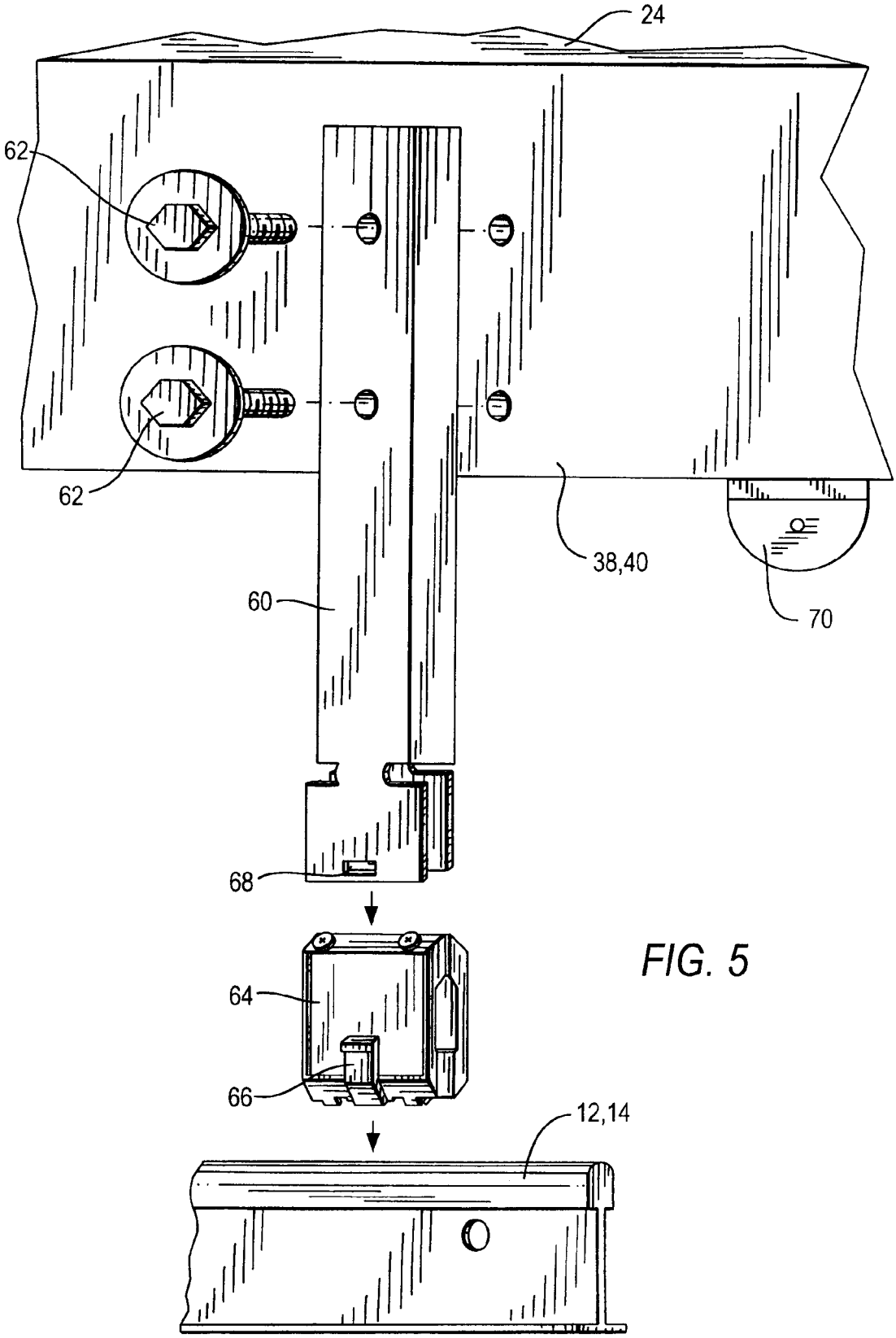
FIG. 5 is a broken-away, enlarged, exploded, perspective view of another embodiment of a support for mounting the electrical apparatus of the overhead arrangement of FIG. 1 on the suspended ceiling system.
Figure 6:
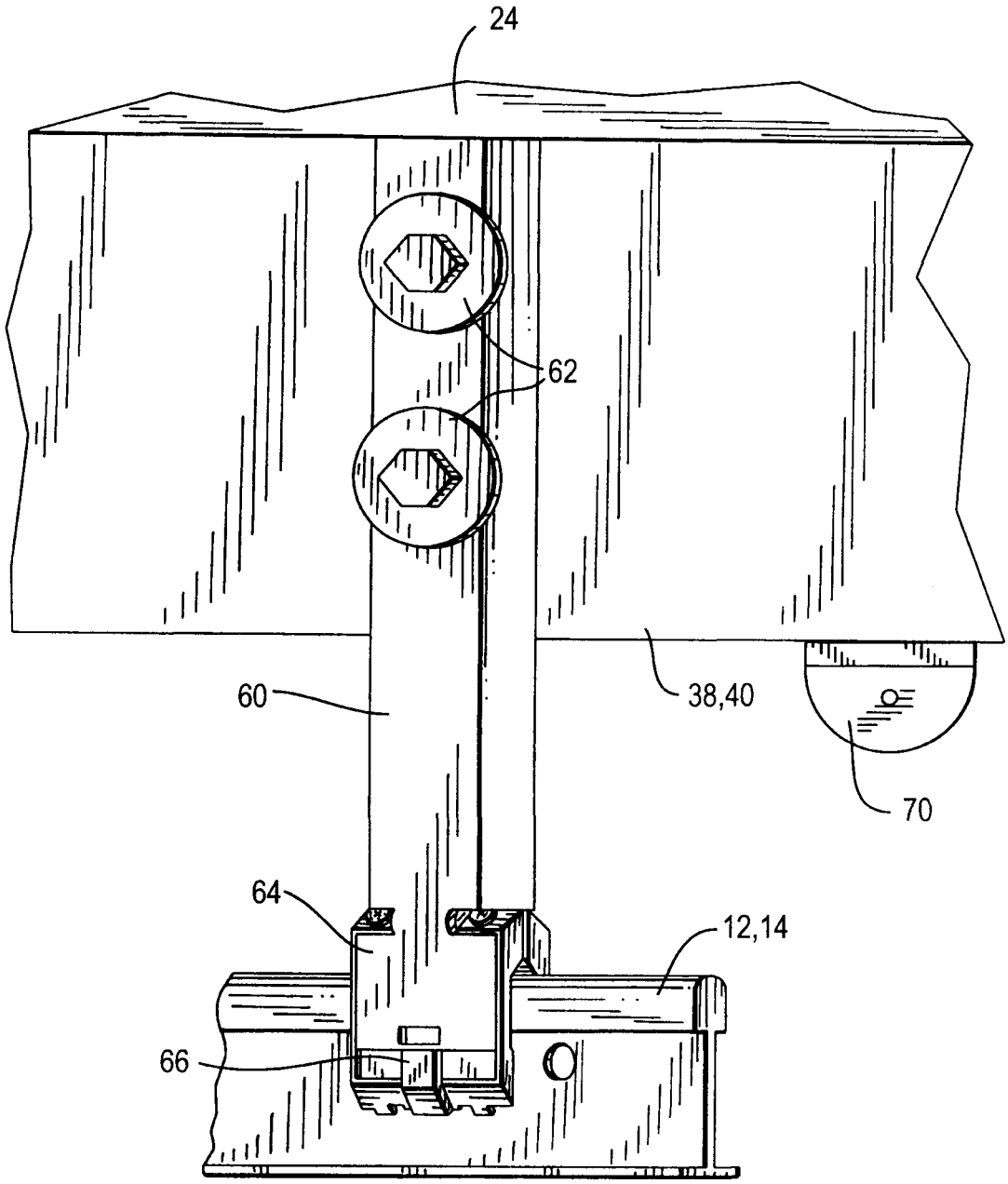
FIG. 6 is a view of the embodiment of FIG. 5, after assembly.

FIGS. 5-6 depict a different type of support for the housing 24 on the frame elements 12, 14. The support bars are eliminated, and instead, the support comprises at least one support leg 60, and preferably a pair of such support legs 60, detachably fastened at a respective upper end region of a respective leg 60 to each side wall 38, 40 of the housing 24, by at least one threaded fastener 62, and preferably by a pair of such fasteners 62, each such fastener 62 threadedly engaging a threaded hole in the housing 24. Each leg 60 extends downwardly from the housing 24 for a distance corresponding to said elevation. A fastener or clip 64 is connected by snap action at a respective lower end region of a respective leg 60. The fastener or clip 64 has a resilient tab 66 that deflects as the clip 64 is inserted into the respective leg 60, and that moves into a hole 68 in the respective leg 60 with a locking action upon full insertion. The fastener or clip 64 friction tightly and detachably engages the vertical web portions of the frame elements 12, 14 with a snug fit. Thus, the legs 60 are removable from the housing 24 to facilitate compact shipping, and to offer different mounting options via the threaded holes in the housing 24. For example, a wall bracket can be attached at the threaded holes in the housing 24 to allow a wall mounting. The housing is typically supported in a horizontal plane, as illustrated.

The electrical apparatus 22 can be any piece of electrical apparatus that is used in the plenum above the suspended ceiling system in support of infrastructure services. It is especially desirable to supply direct current (DC) voltage to power electrical equipment in an office or home environment and, hence, the electrical apparatus 22 can be a DC power supply as mentioned above, or any component used to control the DC power, or even an electrical junction box to route the DC power. The electrical apparatus 22 does not rest directly on top of the ceiling tile 18, nor is the electrical apparatus 22 positioned so closely to the ceiling tile 18 that only limited movement of the ceiling tile 18 is enabled. It is unnecessary to move equipment and/or cables in the plenum out of the way of the electrical apparatus 22 to gain access to the electrical apparatus, thereby minimizing labor cost and the time needed to effect infrastructure service.

It will be understood that each of the elements described above, or two or more together, also may find a useful application in other types of constructions differing from the types described above.

While the invention has been illustrated and described as an accessible control panel of an overhead electrical apparatus in a suspended ceiling system, it is not intended to be limited to the details shown, since various modifications and structural changes may be made without departing in any way from the spirit of the present invention. For example, additional support can be provided to the housing 24 by providing apertured lugs 70 to spaced-apart locations on a top wall or a bottom wall of the housing 24, and by tying wires, such as ceiling wires 20, to each lug 70 on the top wall through their apertures to the overhead ceiling and/or by tying wires to each lug 70 on the bottom wall through their apertures to apertures in the frame elements 12, 14.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

We claim

1. An overhead arrangement in a suspended ceiling system having a framework lying in a ceiling plane and bounding openings for supporting ceiling members, comprising:

an electrical power control apparatus having a housing containing electrical circuitry for controlling and supplying electrical DC power to electrical equipment operatively connected to the electrical power control apparatus outside the housing;

a support for supporting the housing on the framework such that a generally planar bottom wall of the housing lies in a horizontal plane generally parallel to the ceiling plane at an elevation directly above one of the ceiling members supported in one of the openings, the elevation being of sufficient height to prevent mechanical interference between the one ceiling member and the housing when the one ceiling member is at least partially removed from the one opening; and a slanted control panel on the housing and obliquely and downwardly inclined relative to the bottom wall of the housing, the entire slanted control panel being supported in an overlying relationship directly above, and being positioned entirely within, the one opening to enable access through the one opening to the slanted control panel from below the framework when the one ceiling member is at least partially removed from the one opening.

2. The overhead arrangement of claim 1, wherein the slanted control panel includes at least one manually actuatable control that directly overlies the one opening and is manually actuated when manual access is enabled through the one opening.

3. The overhead arrangement of claim 1, wherein the slanted control panel includes at least one display that directly overlies the one opening and is visible when visual access is enabled through the one opening.

4. The overhead arrangement of claim 1, wherein the slanted control panel includes an openable door that directly overlies the one opening and is opened to gain access to an interior of the housing.

5. The overhead arrangement of claim 1, wherein the one opening has a quadrilateral shape, and wherein the housing has a generally triangular shape.

6. The overhead arrangement of claim 5, wherein the generally triangular housing has two side walls lying in mutually orthogonal planes that are generally perpendicular to the ceiling plane, and wherein the slanted control panel is a third wall of the generally triangular housing.

7. The overhead arrangement of claim 6, wherein the slanted control panel meets the side walls of the generally triangular housing at two generally planar corner walls obliquely inclined relative to the side walls and the slanted control panel.

8. The overhead arrangement of claim 1, wherein the support includes fasteners for fastening the housing above and to the framework, and support legs extending upwardly from the fasteners.

9. An overhead arrangement in a suspended ceiling system having a grid framework of frame elements lying in a ceiling plane and bounding a plurality of openings for supporting a corresponding plurality of ceiling members, comprising:

an electrical power control apparatus having a housing for containing electrical circuitry for controlling and supplying electrical DC power to electrical equipment operatively connected to the electrical power control apparatus outside the housing;

a support for supporting the housing on the framework such that a generally planar bottom wall of the housing lies in a horizontal plane generally parallel to the ceiling plane at an elevation directly above one of the ceiling members supported in one of the openings, the elevation being of sufficient height to prevent mechanical interference between the one ceiling member and the housing when the one ceiling member is entirely removed from the one opening; and a slanted control panel on the housing and having manually accessible controls and visually accessible displays, the slanted control panel being obliquely and downwardly inclined relative to the bottom wall of the housing, the entire slanted control panel being supported in an overlying relationship directly above, and being positioned entirely within, the one opening to enable manual access to the controls and visual access to the displays through the one opening to the slanted control panel from below the framework when the one ceiling member is entirely removed from the one opening.

10. The overhead arrangement of claim 9, wherein the slanted control panel includes an openable door that directly overlies the one opening and is opened to gain access to the electrical circuitry contained in the housing.

11. The overhead arrangement of claim 9, wherein the housing overlies at least part of the one opening.

12. The overhead arrangement of claim 11, wherein the one opening has a quadrilateral shape, and wherein the housing has a generally triangular shape.

13. The overhead arrangement of claim 12, wherein the generally triangular housing has two side walls lying in mutually orthogonal planes that are generally perpendicular to the ceiling plane, and wherein the slanted control panel is a third wall of the generally triangular housing.

14. The overhead arrangement of claim 13, wherein the slanted control panel meets the side walls of the generally triangular housing at two generally planar corner walls obliquely inclined relative to the side walls and the slanted control panel.

15. The overhead arrangement of claim 9, wherein the support includes fasteners for detachably fastening the housing above and to the framework, and support legs extending upwardly from, and detachably connected to, the fasteners.

16. In a suspended ceiling system having a grid framework of frame elements lying in a ceiling plane and bounding a plurality of openings for supporting a corresponding plurality of ceiling members, a servicing method comprising the steps of:

mounting, on the framework, an electrical power control apparatus having a housing containing electrical circuitry for controlling and supplying electrical DC power to electrical equipment operatively connected to the electrical power control apparatus outside the housing such that a generally planar bottom wall of the housing lies in a horizontal plane generally parallel to the ceiling plane at an elevation directly above one of the ceiling members supported in one of the openings, the elevation being of sufficient height to prevent mechanical interference between the one ceiling member and the housing when the one ceiling member is at least partially removed from the one opening; and enabling access through the one opening to a control panel on the housing from below the framework by at least partially removing the one ceiling member from the one opening without mechanical interference between the one ceiling tile and the housing, and by obliquely and downwardly inclining the control panel relative to the bottom wall of the housing, and by supporting the control panel to entirely overlie directly above, and to be positioned entirely within, the one opening.

17. The method of claim 16, and mounting manually accessible controls and visually accessible displays in a directly overlying relationship with the one opening on the control panel.

* * * * *